US005243796A

United States Patent [19]

Casini

[11] Patent Number: 5,243,796

[45] Date of Patent: Sep. 14, 1993

[54] MULTISTORY AUTOMOBILE PARKING FACILITY

[75] Inventor: Gianfranco Casini, Rome, Italy

[73] Assignee: Parking Gruppo C., Rome, Italy

[21] Appl. No.: 465,078

[22] PCT Filed: May 4, 1989

[86] PCT No.: PCT/IT89/00031

§ 371 Date: Oct. 17, 1991

§ 102(e) Date: Oct. 17, 1991

[87] PCT Pub. No.: WO89/11013

PCT Pub. Date: Nov. 16, 1989

[30] Foreign Application Priority Data

May 4, 1988 [IT] Italy ..... 47918 A/88

[51] Int. Cl.[5] ..... E01F 9/00

[52] U.S. Cl. ..... 52/175; 52/30; 52/33; 414/256; 414/260; 414/237

[58] Field of Search ..... 52/175, 30, 33; 414/256, 260, 252, 253, 239, 264, 282, 233

[56] References Cited

U.S. PATENT DOCUMENTS

| | | | |
|---|---|---|---|
| 2,412,009 | 12/1946 | Rickland . | |
| 2,816,624 | 12/1957 | Asheim et al. . | |
| 2,930,497 | 3/1960 | Wheeler . | |
| 2,951,599 | 9/1960 | Bogar . | |
| 3,211,302 | 10/1965 | Bianca . | |
| 3,924,300 | 12/1975 | Hilger . | |
| 4,307,985 | 12/1987 | Desprez . | |
| 4,787,804 | 11/1988 | Edenas . | |
| 4,936,730 | 6/1990 | Morioka . | |
| 4,986,714 | 1/1991 | Fernstrom . | |
| 5,018,926 | 5/1991 | Sternad . | |

FOREIGN PATENT DOCUMENTS

| | | | |
|---|---|---|---|
| 958378 | 11/1974 | Canada . | |
| 41241 | 12/1981 | European Pat. Off. | 52/175 |
| 1941324 | 8/1969 | Fed. Rep. of Germany | 52/175 |
| 2058404 | 12/1972 | Fed. Rep. of Germany . | |
| 2926263 | 1/1981 | Fed. Rep. of Germany | 52/175 |
| 2928288 | 1/1981 | Fed. Rep. of Germany | 52/175 |
| 3309190 | 9/1984 | Fed. Rep. of Germany . | |
| 602179 | 3/1927 | France . | |
| 1437539 | 3/1966 | France . | |
| 2068896 | 9/1971 | France . | |
| 8400046 | 1/1984 | France | 52/175 |
| 657504 | 11/1963 | Italy . | |
| 660454 | 12/1964 | Italy . | |
| 143139 | 6/1985 | Italy | 52/175 |
| 275004 | 7/1988 | Italy | 52/175 |
| 904832 | 8/1962 | United Kingdom . | |
| 1140556 | 1/1969 | United Kingdom . | |
| 2153801A | 8/1985 | United Kingdom . | |

OTHER PUBLICATIONS

Popular Science, On the Way: Parking Problems? These devices swing & stack your car to get it out of your hair, 1960.

*Primary Examiner*—Richard E. Chilcot, Jr.
*Assistant Examiner*—Beth A. Aubrey
*Attorney, Agent, or Firm*—Beveridge, DeGrandi, Weilacher & Young

[57] ABSTRACT

The facility consists of a silo module of either reinforced concrete or steel, built above or below ground level, or partly above and partly below ground level. The central section of the silo interior is occupied by a handling unit that can be of an electromechanical type, for the transfer of automobiles onto the lateral storage stalls and their retrieval. The incoming and outgoing automobile handling operations are carried out by means of metal platforms on which the automobiles are loaded. The platforms are hoisted and transferred horizontally by the electromechanical unit. The platform holding the incoming vehicle is hoisted to the level at which a free place is found available and then moved horizontally and made rest on stationary iron brackets abutting from the silo module walls and located on various levels. The module can be provided with a sole doorway to be used as both entry and exit, and alternatively, can have two doorways opposing each other, one for entry and the other for exit. The entry and/or exit doorway(s) are located at either the bottom level, the top level or the intermediate level of the silo according to the construction criterion (totally underground, partially underground or above ground). The silo module plan and elevation sizes can vary according to requirements.

10 Claims, 3 Drawing Sheets

FIG. 1
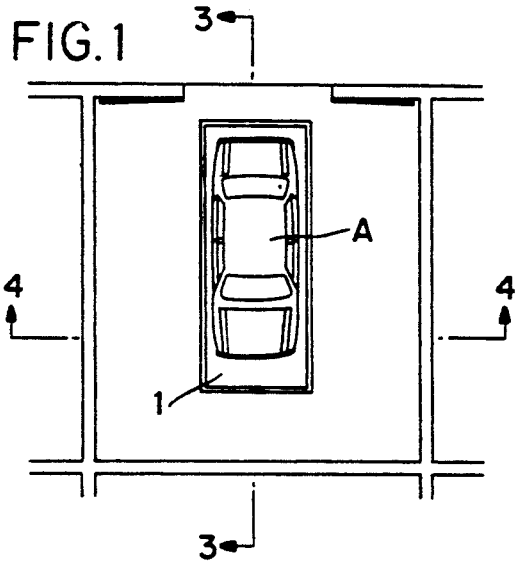
FIG. 2
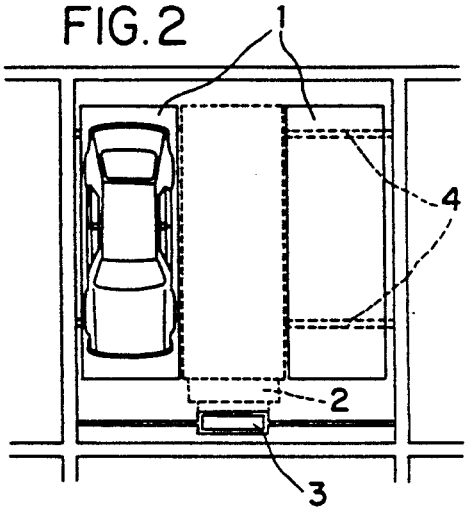
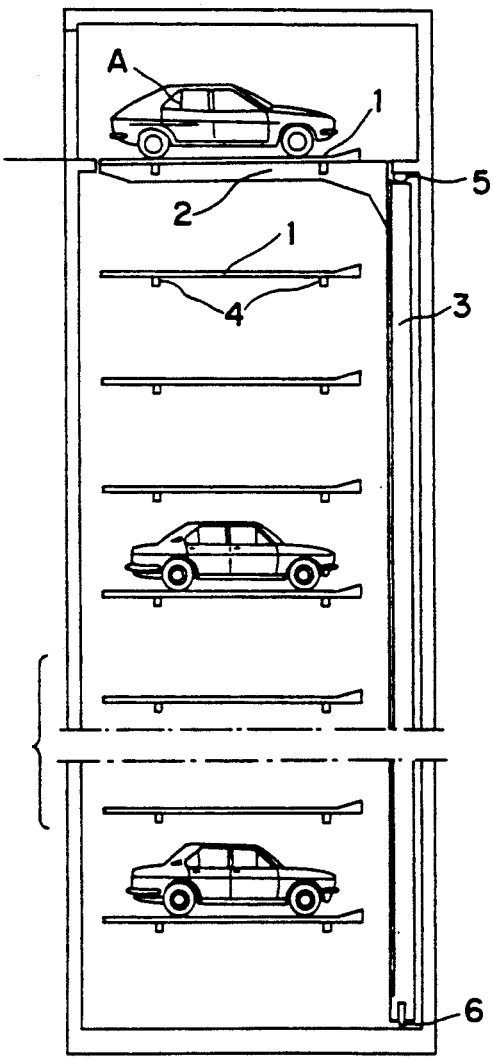
FIG. 3
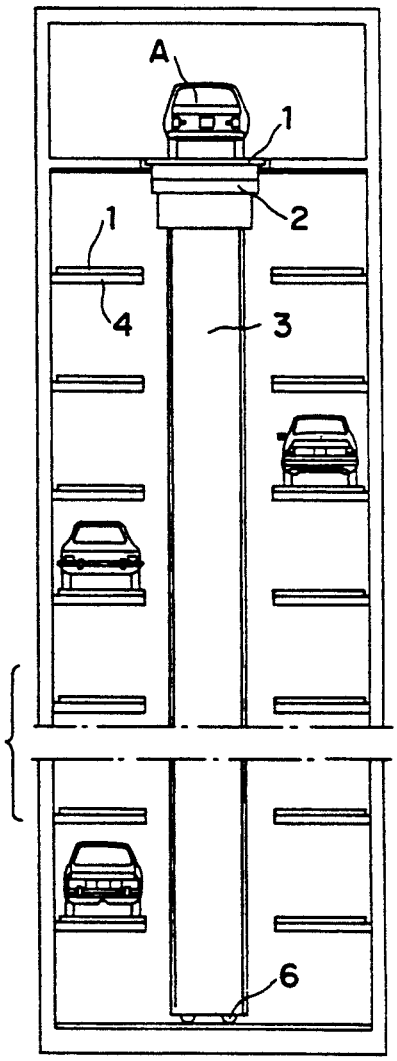
FIG. 4

MULTISTORY AUTOMOBILE PARKING FACILITY

FIELD OF THE INVENTION

The invention relates to a multistory automobile parking facility.

SUMMARY OF THE INVENTION

The purpose of the present invention is to build a simple and easy to operate multistory automobile parking facility.

The invention consists of an ensilage system in one or several monolithic modules (silos) made of reinforced concrete and/or steel.

Each monolithic module is provided with an automobile entry doorway; their exit can be on the same side or on the opposite side.

The interior of the module houses ranges of brackets extend outward from the walls on both sides of the entrance.

The brackets (FIG. 3, no. 1) are arranged on parallel stories at a distance of about 2 meters from each other. The vertical spacing between brackets can be, in all or only several stories on one silo, more or less than 2 meters according to the type of vehicle to be parked (trailers, caravans, campers, etc.). The electromechanical handling unit transfers the incoming vehicles into the parking stalls and retrieves them upon their release from the silo.

BRIEF DESCRIPTION OF THE DRAWINGS

The invention is described in detail with the support of drawings exemplifying execution as follows:

FIGS. 1 and 2: layout of the access area and layout of an automobile parking story;

FIGS. 3 and 4: longitudinal view and transverse view of one portion of the facility;

Figure 5:
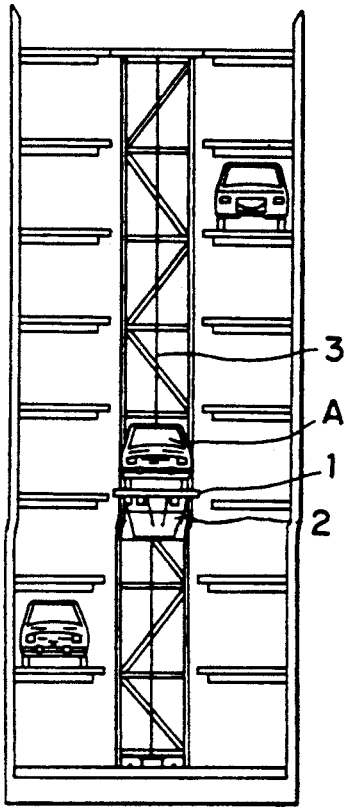
FIGS. 5, 6 and 7: cross-sectional outline of the sequence of movement of a vehicle onto its stall.
Figure 6:
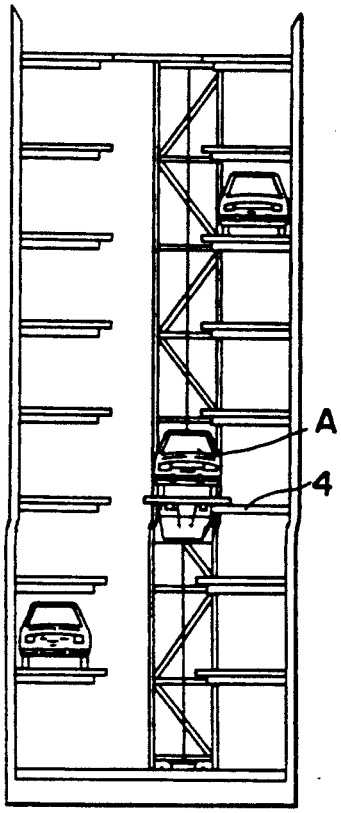
Figure 7:
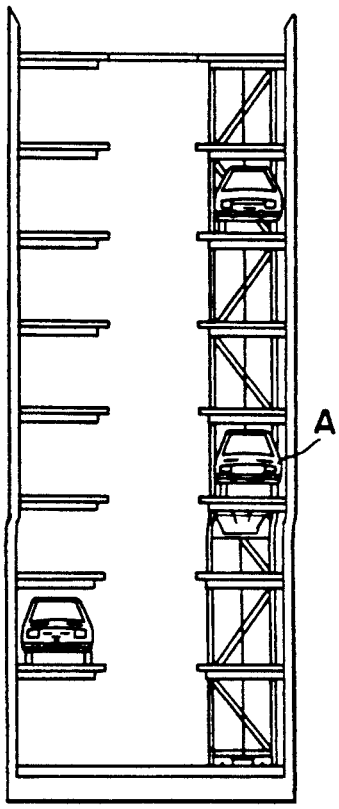

The invention arises from the idea of accomodating—through a manually and/or automatically operated electromechanical system—vehicles inside one or several container silos each of which provided with two opposed ranks of stationary brackets (FIG. 4), extending in cantilever-like fashion from the walls and aligned and arranged on several storys. The brackets provide support to platforms (FIG. 1, no. 1) on which the vehicles to be parked are placed. Also, as shown in FIGS. 3 and 4, with the exception of vehicle support platforms, there is free space extending along a vertical plane between the uppermost fixed brackets and the lowermost fixed brackets.

The vehicle, together with the platform on which it was made to stand, is picked up and set down by an electromechanical handling unit composed of a movable platform (FIG. 3, no. 2), a moving mast (FIG. 4, no. 3), and computer-manually or semi-automatically controlled electric motors.

The mast (FIGS. 3 and 4, no. 3) consists of a metal structure. It moves horizontally through rollers running on overhead guides (FIG. 3, no. 5) and base wheels running on rails (FIGS. 3 and 4, no. 6). The horizontal movement of the mast can also be effected by means of a rack rail.

The mast holds a movable platform running vertically on guides. The movable platform 2 attached to the mast can run through a chain- or rope drive; alternatively through a rack drive with or without a balance weight.

The movable platform (FIGS. 3 and 4, no. 2) accomplishes vertical motion along the mast and a horizontal transfer motion solidly with the mast.

The movable platform receives the platform on which the vehicle to be parked is made to rest at the initial step of the parking procedure.

The movable platform, with its vertical motion, hoists the car or vehicle support platform to the height of the bracket on which it is to be accommodated.

Thereafter, the supporting mast (FIGS. 3 and 4, no. 3) transfers laterally the movable platform supporting the car plaform onto the supporting bracket. This motion is made possible by the metal structure of the movable platform (FIG. 3, no. 2) being provided with grooves made to fit onto the wall brackets (FIG. 4, no. 4). The car platforms (FIG. 1, no. 1) are provided with profiles that prevent any shifts of the vehicles resting on them, in addition to being endowed with locking and centering devices for their own correct positioning on the movable mast platform.

The vehicle to be parked A is positioned by the user on the vehicle platform 1 located on the access story, correct vehicle positioning being ascertained through special sensors (not shown).

When the user has relinquished the vehicle, the vehicle platform 1, supported by the movable mast platform 2, starts to be raised vertically up to the height of the bracket selected. Thereafter, the supporting mast 3 moves laterally, thus transferring the platform carrying the vehicle onto that bracket. At this point, the transfer mast 3 together with its free platform 2 returns to its central position and repeats the same procedure to seek a free vehicle platform 1, upon finding one, lifts it from the bracket 4 and transfers it to the parking access story.

The vehicle retrieval and delivery procedure will be obviously the opposite to that described.

Figure 8:
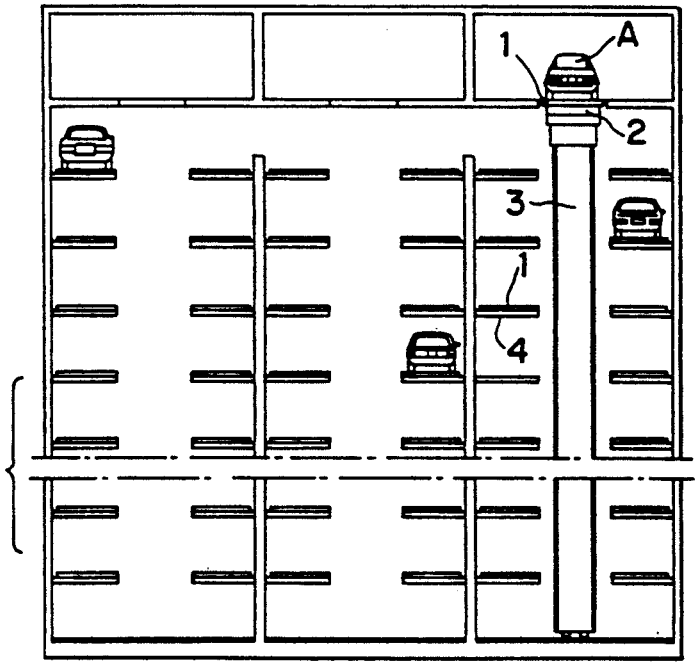
FIGS. 8, 9 and 10: vertical section, plan of the access story and plan of a parking story in a side to side stall arrangement design.
Figure 9:
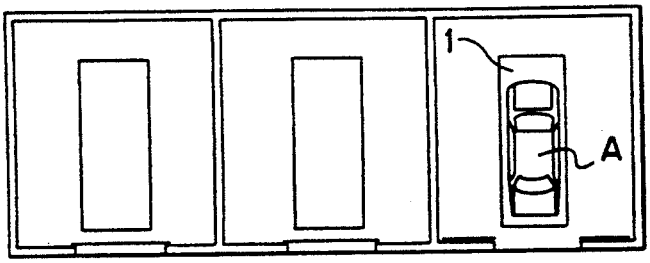
Figure 10:
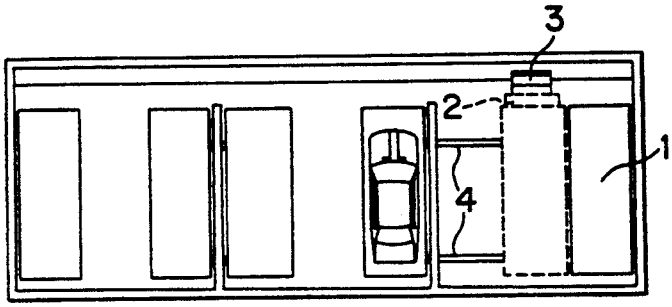
Figure 11:
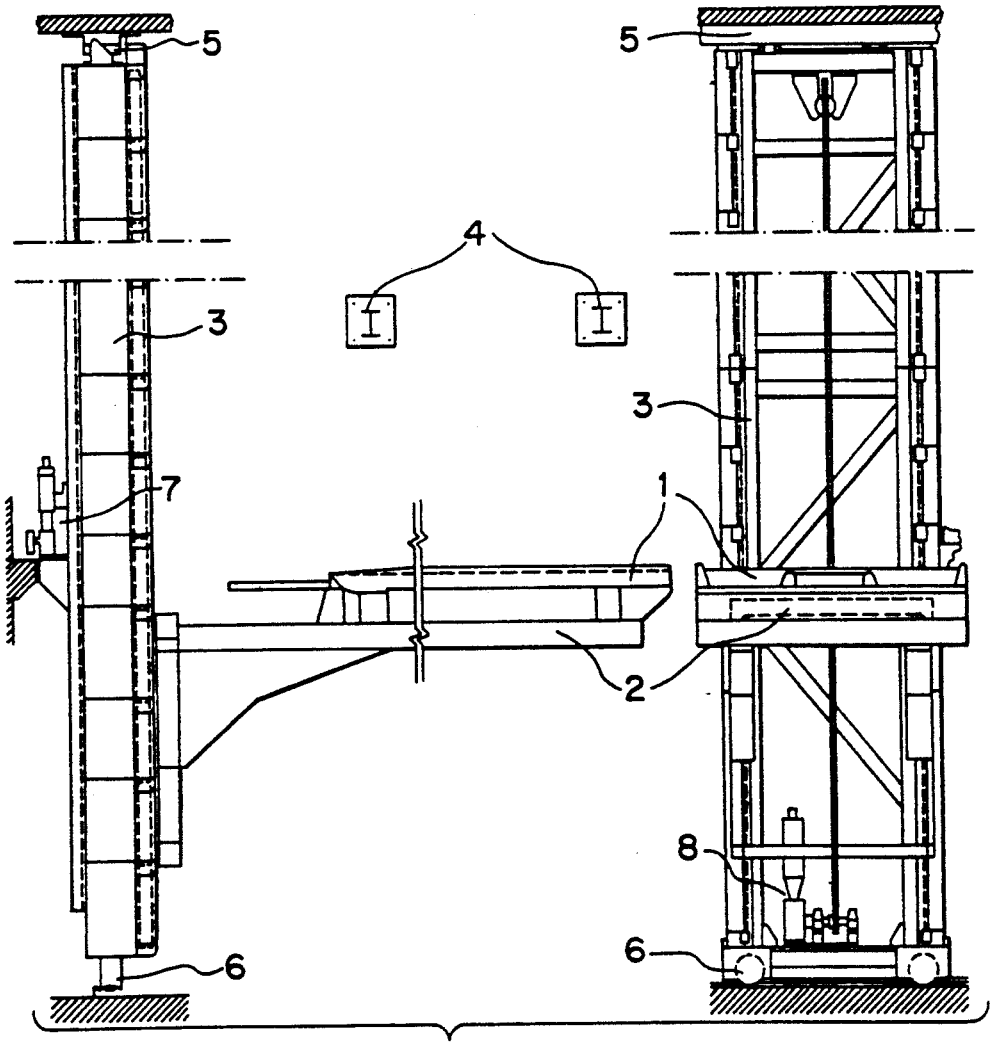
FIG. 11: handling unit.

When required, a single handling unit can be used to operate more than one silo modules located side by side (FIGS. 8, 9 and 10), by moving from one to the next through a horizontal motion and through special openings in the vertically extending partition walls. When the mast and its movable platform move without carrying a vehicle, their horizontal transfer can occur without having to go through the partition wall openings located superiorly, when the mast platform is collapsible by turning around an axis located near the mast and parallel to the direction of the horizontal shift, this resulting in shorter handling cycle times. The facility can be automated (computer-aided vehicle handling) or operated manually, in addition to making use of a mixed automated-manual method.

The disclosure is made by the submittal of a design selected which is not meant to be restrictive or limiting of all its possible applications. Provided that the invention principle is maintained, the building form and details can be varied from the description and illustrations supplied without exceeding the scope of the instant invention.

I claim:

1. A parking facility, comprising:

a silo which extends vertically;

a mast extending in a vertical direction with said silo and said mast being dimensioned and arranged for movement in a first direction transverse to the vertical direction;

a movable platform supported by said mast such that said movable platform is adapted for vertical movement up and down said mast and along a first vertical plane, said movable platform extending away from said mast in a second direction which is essentially perpendicular to the vertical and to said first direction;

fixed brackets supported by said silo and extending away from said silo along said first direction, a first group of fixed brackets being positioned to one side of said first vertical plane and a second group of fixed brackets being positioned to an opposite side of said first vertical plane;

vehicle support platforms each of which are dimensioned and arranged for supporting a vehicle, and said fixed brackets being dimensioned and arranged to support said vehicle support platforms essentially horizontally and in stories spaced along the vertical, and said fixed brackets each having a free end that is dimensioned and arranged to extend between said movable platform and a vehicle support platform supported by said movable platform upon a shifting of said movable platform in the first direction past the free ends of said fixed brackets, and said vehicle support platforms being releasably supported by said movable platform such that said vehicle support platforms are supported both by said fixed brackets and said movable platform during operation of said parking facility.

2. A parking facility as recited in claim 1 wherein said groups of fixed brackets include pairs of individually fixed brackets spaced from one another along said second direction, and each of said pairs being vertically spaced in series along said silo.

3. A parking facility as recited in claim 1 wherein, with the exception of said releasable vehicle support platforms, said silo is free from any structure along a second plane perpendicular to said first plane and extending between a lowermost pair of said fixed brackets and an uppermost pair of said fixed brackets and extending in the first direction for a length equal to the length said fixed brackets extend out from said silo.

4. A parking facility as recited in claim 1 wherein said silo includes a vehicle entrance positioned such that said first plane extends therethrough.

5. A parking facility as recited in claim 4 wherein said silo includes a vehicle exit positioned such that said first plane extends therethrough.

6. A parking facility as recited in claim 1 wherein said movable platform has recesses formed therein which are dimensioned and arranged to receive a corresponding number of fixed brackets and which are positioned below a vehicle supporting platform when said vehicle supporting platform is supported on said movable platform.

7. A parking facility as recited in claim 1 wherein said fixed brackets include elongated bars extending in cantilever fashion off from said silo.

8. A parking facility as recited in claim 1 further comprising a vertically extending interior wall arranged parallel to said first plane and additional fixed brackets extending transversely off from said interior wall, and said mast being adapted for movement along said first direction to opposite sides of said interior wall such that said movable platform is vertically adjustable along a second plane which is spaced from a side of said interior wall that is furthest removed from said first plane.

9. A parking facility as recited in claim 1 wherein said silo is rectangular in cross-section with a vertical side wall extending in said first direction, and said mast being positioned, in a direction taken along said second direction, between said side wall and said fixed brackets.

10. A parking facility as recited in claim 1 wherein said movable platform is collapsible through rotation about an axis extending along said first direction such that said movable platform moves from an essentially horizontal position to a vertically extending position.

* * * * *